US008187057B2

(12) United States Patent
Broecker

(10) Patent No.: US 8,187,057 B2
(45) Date of Patent: May 29, 2012

(54) BLAST NOZZLE WITH BLAST MEDIA FRAGMENTER

(75) Inventor: Richard Broecker, Milford, OH (US)

(73) Assignee: Cold Jet LLC, Loveland, OH (US)

( * ) Notice: Subject to any disclaimer, the term of this patent is extended or adjusted under 35 U.S.C. 154(b) by 546 days.

(21) Appl. No.: 12/348,645

(22) Filed: Jan. 5, 2009

(65) Prior Publication Data

US 2010/0170965 A1 Jul. 8, 2010

(51) Int. Cl.
*B24B 1/00* (2006.01)

(52) U.S. Cl. ..... 451/38; 451/39; 451/40; 451/89; 451/90; 451/102

(58) Field of Classification Search ..... 451/38, 451/39, 40, 75, 89, 90, 102; 239/650, 654; 72/53; 134/198; 406/92, 192, 194; 241/5, 241/40

See application file for complete search history.

(56) References Cited

U.S. PATENT DOCUMENTS

| | | | | |
|---|---|---|---|---|
| 1,848,122 | A | 3/1932 | Forster | |
| 2,282,460 | A | 5/1942 | Dickey | |
| 3,070,967 | A | 1/1963 | Uren | |
| 3,576,112 | A | 4/1971 | Frost et al. | |
| 3,670,516 | A | 6/1972 | Duron et al. | |
| 3,952,530 | A | 4/1976 | Tyree, Jr. | |
| 4,655,847 | A * | 4/1987 | Ichinoseki et al. | 134/7 |
| 4,727,687 | A | 3/1988 | Moore | |
| 4,744,181 | A | 5/1988 | Moore et al. | |
| 4,843,770 | A | 7/1989 | Crane et al. | |
| 4,947,592 | A | 8/1990 | Lloyd et al. | |
| 5,018,667 | A | 5/1991 | Lloyd | |
| 5,050,805 | A | 9/1991 | Lloyd et al. | |
| 5,071,289 | A | 12/1991 | Spivak | |

(Continued)

FOREIGN PATENT DOCUMENTS

DE 10 2007 018 3 10/2008

(Continued)

OTHER PUBLICATIONS

International Search Report and Written Opinion dated Apr. 20, 2010 for Application No. PCT/US2009/069699.

(Continued)

*Primary Examiner* — George Nguyen
(74) *Attorney, Agent, or Firm* — Frost Brown Todd LLC

(57) ABSTRACT

A media blast nozzle for cleaning a surface with compressed air and ejected particles of a sublimating blast media comprises a media size changer to change a size of the blast media particles. The media blast nozzle has an entrance and an exit and a throat therebetween. A converging passageway extends from the entrance to the throat, and a diverging passageway extends from the throat to the exit. The media size changer is operably located in the diverging passageway and has one or more media size changing members to fragment moving blast media particles by impact therewith. The blast media particles are provided to the media blast nozzle in an initial consistent size, and when a moving blast media particle impacts with one or more media size changing members, two or more fragments of reduced size are created from the initial blast media particle for ejection from the nozzle device. The media size changer can be adjusted by an operator to eject whole particles or fragments of particles. The size of the ejected particle fragments can also be adjusted with the media size change

27 Claims, 13 Drawing Sheets

U.S. PATENT DOCUMENTS

| | | | | |
|---|---|---|---|---|
| 5,109,636 | A | 5/1992 | Lloyd et al. | |
| 5,188,151 | A | 2/1993 | Young et al. | |
| 5,203,794 | A * | 4/1993 | Stratford et al. | 451/75 |
| 5,249,426 | A | 10/1993 | Spivak et al. | |
| 5,265,383 | A * | 11/1993 | Shank, Jr. | 451/102 |
| 5,283,990 | A | 2/1994 | Shank, Jr. | |
| 5,288,028 | A | 2/1994 | Spivak et al. | |
| 5,301,509 | A | 4/1994 | Lloyd et al. | |
| H1379 | H | 12/1994 | Meuer | |
| 5,473,903 | A | 12/1995 | Lloyd et al. | |
| 5,520,572 | A | 5/1996 | Open et al. | |
| 5,525,093 | A | 6/1996 | Palmer, Jr. | |
| 5,528,907 | A | 6/1996 | Pint et al. | |
| 5,571,335 | A | 11/1996 | Lloyd | |
| 5,616,067 | A | 4/1997 | Goenka | |
| 5,623,831 | A | 4/1997 | Mesher | |
| 5,660,580 | A | 8/1997 | Lehnig | |
| 5,679,062 | A | 10/1997 | Goenka | |
| 5,765,766 | A * | 6/1998 | Yoshida et al. | 241/39 |
| 5,795,214 | A | 8/1998 | Leon | |
| 6,024,304 | A | 2/2000 | Sawada | |
| 6,042,458 | A | 3/2000 | Lehnig et al. | |
| 6,173,916 | B1 | 1/2001 | Krone-Schmidt | |
| 6,318,649 | B1 * | 11/2001 | Mazurkiewicz | 241/5 |
| 6,346,035 | B1 | 2/2002 | Anderson et al. | |
| 6,431,470 | B2 | 8/2002 | Berg | |
| 6,447,377 | B1 | 9/2002 | Londenberg et al. | |
| 6,579,041 | B2 * | 6/2003 | Hobbs | 406/121 |
| 6,695,679 | B2 * | 2/2004 | Anderson et al. | 451/2 |
| 6,695,685 | B2 | 2/2004 | Stratford et al. | |
| 6,726,130 | B2 | 4/2004 | Jaubertie | |
| 6,726,549 | B2 | 4/2004 | Rivir et al. | |
| 6,824,450 | B2 | 11/2004 | Opel | |
| 7,344,651 | B2 * | 3/2008 | Jaubertie | 216/58 |
| 7,922,565 | B2 * | 4/2011 | Knisel et al. | 451/99 |
| 2003/0064665 | A1 * | 4/2003 | Opel | 451/40 |
| 2004/0121711 | A1 | 6/2004 | Opel | |

FOREIGN PATENT DOCUMENTS

| | | |
|---|---|---|
| EP | 0 029 867 | 10/1981 |
| JP | 56054217 | 5/1981 |
| WO | WO 91/04449 | 4/1991 |
| WO | WO 94/14572 | 7/1994 |
| WO | WO 94/16861 | 8/1994 |
| WO | WO 03/101667 | 12/2003 |
| WO | WO 2004/033154 | 4/2004 |

OTHER PUBLICATIONS

Search Report dated Jul. 5, 2006 for PCT/US2006/009017.
International Search Report dated Aug. 27, 2008 for Application No. PCT/US2008/063726.
Written Opinion dated Aug. 27, 2008 for Application No. PCT/US2008/063726.
Abstract for JP 56054217.
U.S. Appl. No. 11/123,974, May 6, 2005, Lee et al.

* cited by examiner

BLAST NOZZLE WITH BLAST MEDIA FRAGMENTER

BACKGROUND

Surfaces have been cleaned in a variety of ways including blasting the surface with a media blasting devices using a cryogenic material or media such as carbon dioxide particles or pellets. Media blasting devices eject the carbon dioxide pellets or particles from a media blast nozzle with a blasting or moving stream of air.

Carbon dioxide blasting systems are well known, and along with various associated component parts, are shown in U.S. Pat. Nos. 4,744,181, 4,843,770, 4,947,592, 5,018,667, 5,050,805, 5,071,289, 5,109,636, 5,188,151, 5,203,794, 5,249,426, 5,288,028, 5,301,509, 5,473,903, 5,520,572, 5,571,335, 5,660,580, 5,795,214, 6,024,304, 6,042,458, 6,346,035, 6,447,377, 6,695,679, 6,695,685, and 6,824,450, all of which are incorporated herein by reference.

Typically, particles, also known as blast media, are provided in a uniform size and fed into a transport gas flow to be transported as entrained particles to a blast nozzle. The particles or pellets exit from the blast nozzle with high velocity and are directed toward a work piece or other target (also referred to herein as an article). Particles may be stored in a hopper or generated by the blasting system and directed to the feeder for introduction into the transport gas. One such feeder is disclosed in U.S. Pat. No. 6,726,549, issued on Apr. 27, 2004 for Feeder Assembly For Particle Blast System, which is incorporated herein by reference.

Carbon dioxide particles may be initially formed as individual particles of generally uniform size, such as by extruding carbon dioxide through a die, or as a solid homogenous block. Within the dry ice blasting field, there are blaster systems that utilize pellets/particles and blaster systems which shave smaller blast particles from blocks of dry ice.

An apparatus for generating carbon dioxide granules from a block, referred to as a shaver, is disclosed in U.S. Pat. No. 5,520,572, which is incorporated herein by reference, in which a working edge, such as a knife edge, is urged against and moved across a block of carbon dioxide. These granules so generated are used as carbon dioxide blast media, being fed introduced into a flow of transport gas, such as by a feeder or by venturi induction, by a feeder/air lock configuration, and thereafter propelled against any suitable target, such as a work piece.

It is known to manufacture dry ice pellets/particles at a central location and ship them in suitably insulated containers to customers and work sites, whereas blocks of suitably sized dry ice are not readily available.

While several systems and methods have been made and used for a media blasting nozzle, it is believed that no one prior to the inventors has made or used the invention described in the appended claims.

BRIEF DESCRIPTION OF THE FIGURES

The accompanying drawings, which are incorporated in and constitute a part of this specification, illustrate embodiments of the nozzle device, and, together with the general description of the nozzle device given above, and the detailed description of the embodiments given below, serve to explain the principles of the present nozzle device.

DETAILED DESCRIPTION

The following description of certain examples of the nozzle device should not be used to limit the scope of the present nozzle device. Other examples, features, aspects, embodiments, and advantages of the nozzle device will become apparent to those skilled in the art from the following description, which is by way of illustration, one of the best modes contemplated for carrying out the nozzle device. As will be realized, the nozzle device is capable of other different and obvious aspects, all without departing from the spirit of the nozzle device. Accordingly, the drawings and descriptions should be regarded as illustrative in nature and not restrictive.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Figure 1:
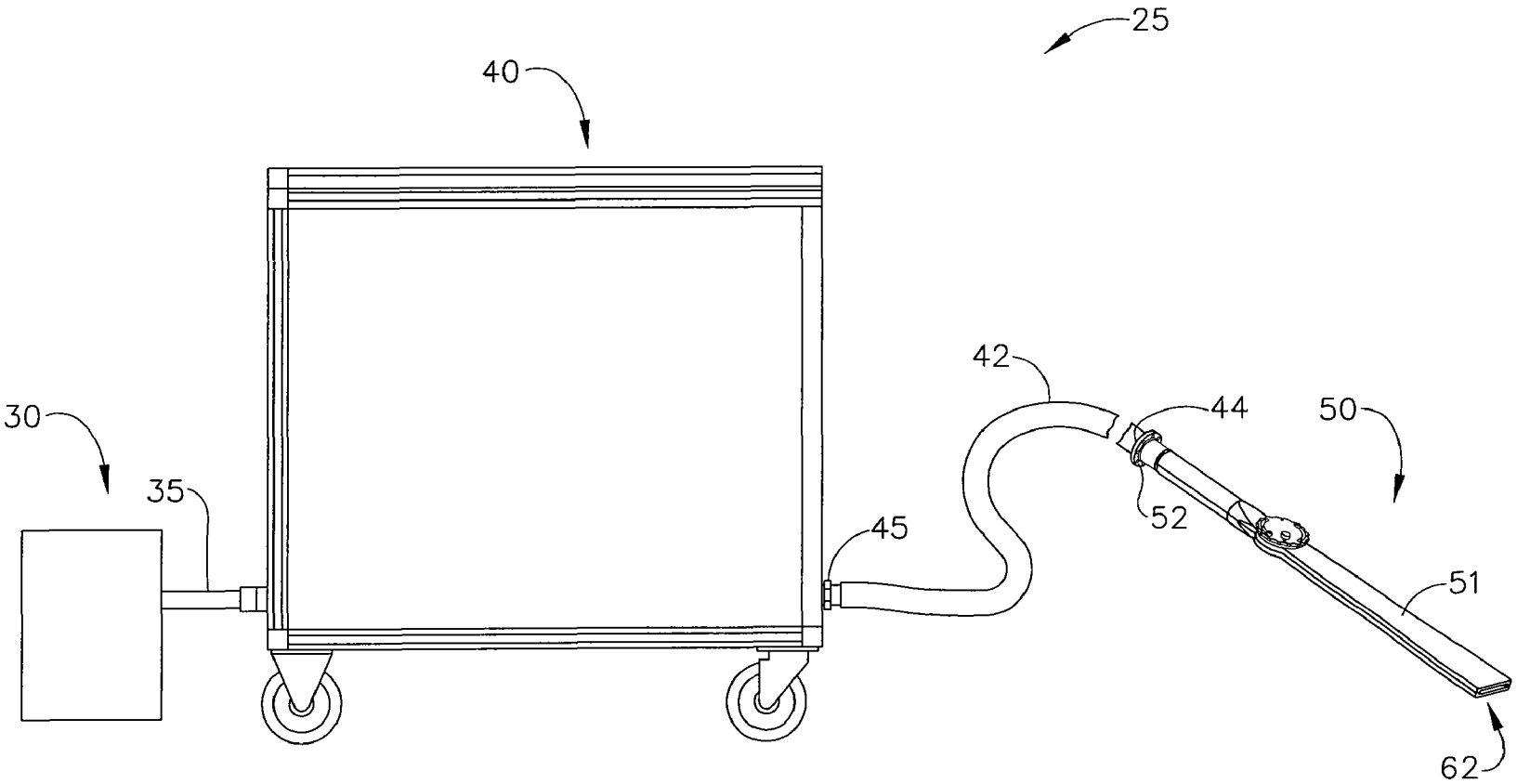
FIG. 1 is an isometric view of a media blasting apparatus with an attached converging/diverging nozzle device for ejecting compressed air and media particles therefrom, the attached nozzle device further having a media size changer.

FIG. 1 shows a blasting apparatus 25 that uses compressed air to eject a blasting media such as carbon dioxide pellets, from an exemplary nozzle device 50. The ejected media is used as an air propelled abrasive to clean unwanted materials such as paint, ink grease and the like from a substrate. One exemplary blast media for use with the exemplary nozzle device 50 is one or more dry ice particles or pellets 41 which, upon impact, provide a thermal shock effect to remove the unwanted material from the substrate. Dry ice blast media or pellets 41 also sublimate into carbon dioxide gas, and can reduce cleanup. The thermal shock effect of the impacting dry ice particles may be used to remove unwanted materials from delicate substrates such as removing caked on grease from a painted surface (substrate) or removing an outer layer of paint from an underlying or substrate layer of paint.

The size of the blasting media may have has an effect on the rate of cleaning of unwanted materials and on the resulting surface finish after blasting. The blasting media sizes can range from larger coarse particles to smaller fine particles. If the velocity of the propelling compressed air is constant, reducing the size (and the mass) of the media particle reduces the kinetic energy of the media particle impacting the unwanted material, and changes the rate of material removal. For rapid material removal, larger media particles are used. Smaller media particles reduce the rate of material removal but offer better control, and can be used on delicate substrates. The exemplary nozzle device 50 of FIGS. 1-21 comprises a media size changer 75 that can receive air and pellets 41 of a first uniform size, and can either eject the pellets 41 whole, or can convert the pellets 41 into pellet fragments 43 of reduced size for ejection from the nozzle device 50. Media size changer 75 uses impact (within the nozzle device 50) to fragment a pellet 41 into two or more fragments 43 of smaller size (FIG. 16). Nozzle device 50 is not limited to carbon dioxide pellets 41 and can be used with other frangible or fragmentable blast media such as walnut shells, glass beads and the like.

In FIG. 1, the blasting apparatus 25 comprises an air source 30 such as a compressor or other shop air source to provide pressurized high velocity air. An air pipe 35 extends downstream from the compressor and carries the pressurized high velocity air to a pellet source 40. Pellet source 40 feeds or delivers one or more dry ice pellets 41 of a generally consistent size and shape into the moving stream of high velocity air for use as the blast media. Pellet source 40 can comprise one or more of a storage hopper, a pellet feeding system, a carbon dioxide ice pellet former, or a shaving device that can shave one or more dry ice pellets 41 of a uniform or consistent size from a block of carbon dioxide ice. A flexible hose 42 extends downstream from the pellet source 40 to deliver the moving stream of compressed high velocity air and pellets 41 into the nozzle device 50. An upstream coupling 43 and a downstream coupling 44 can be provided to attach the flexible hose 42 to the pellet source 40 and the nozzle device 50 respectively.

Exemplary Nozzle Device

Figure 2:
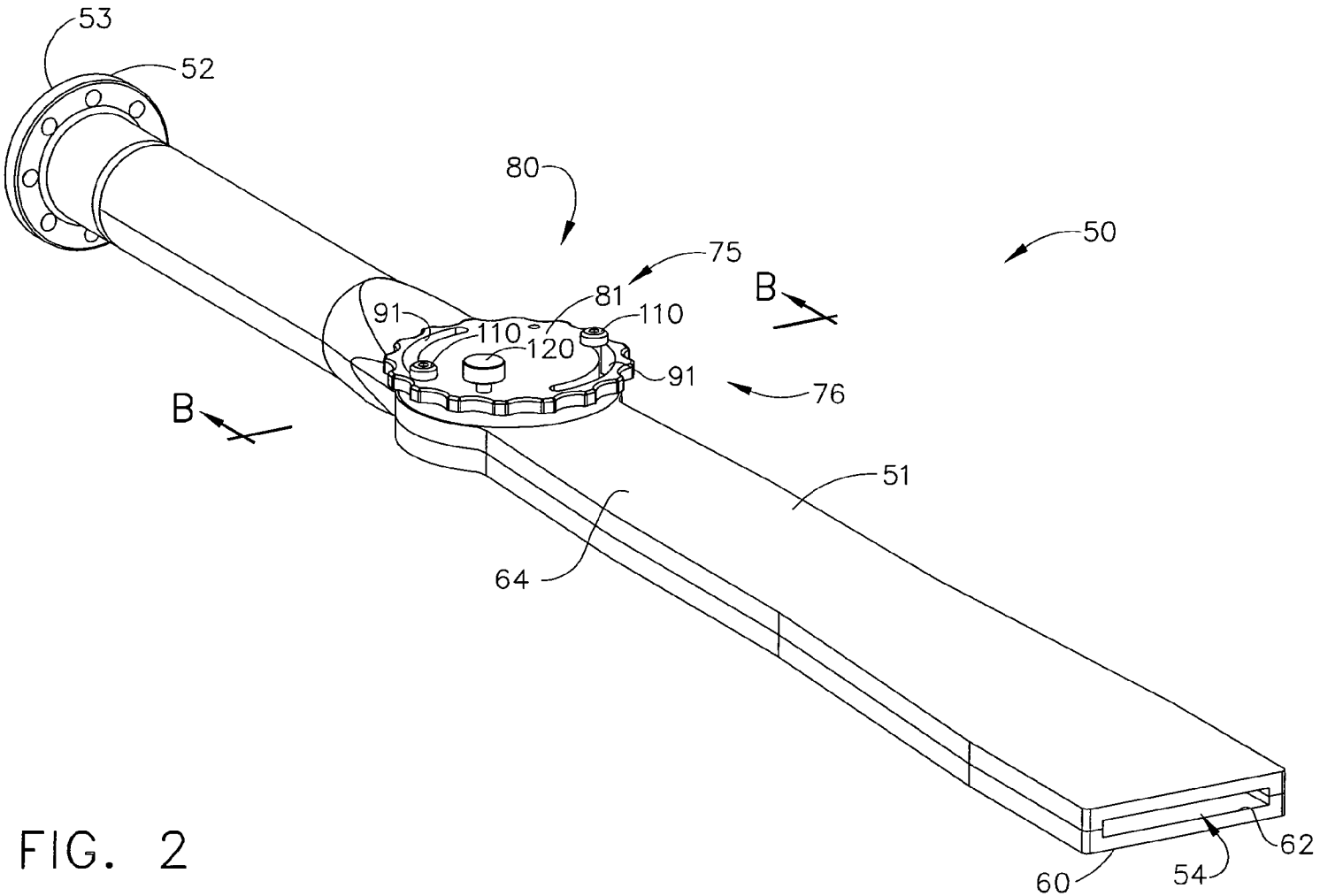
FIG. 2 is an isometric view of the converging/diverging nozzle device of FIG. 1 with an adjustable media size changer.
Figure 3:
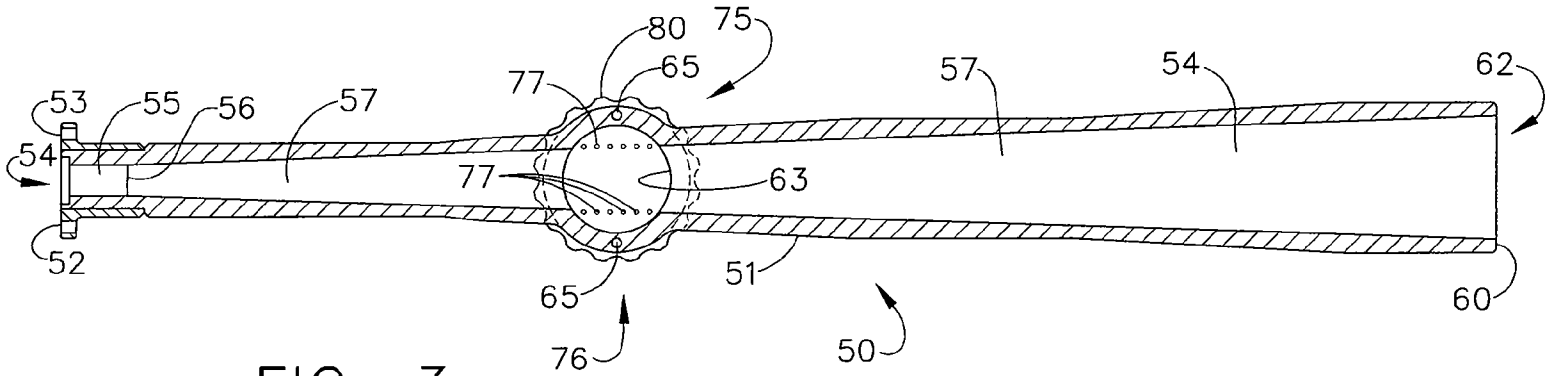
FIG. 3 is an upward section view of the nozzle device of FIG. 2 showing portions of the adjustable media size changer attached to a diverging portion of the nozzle.
Figure 4:
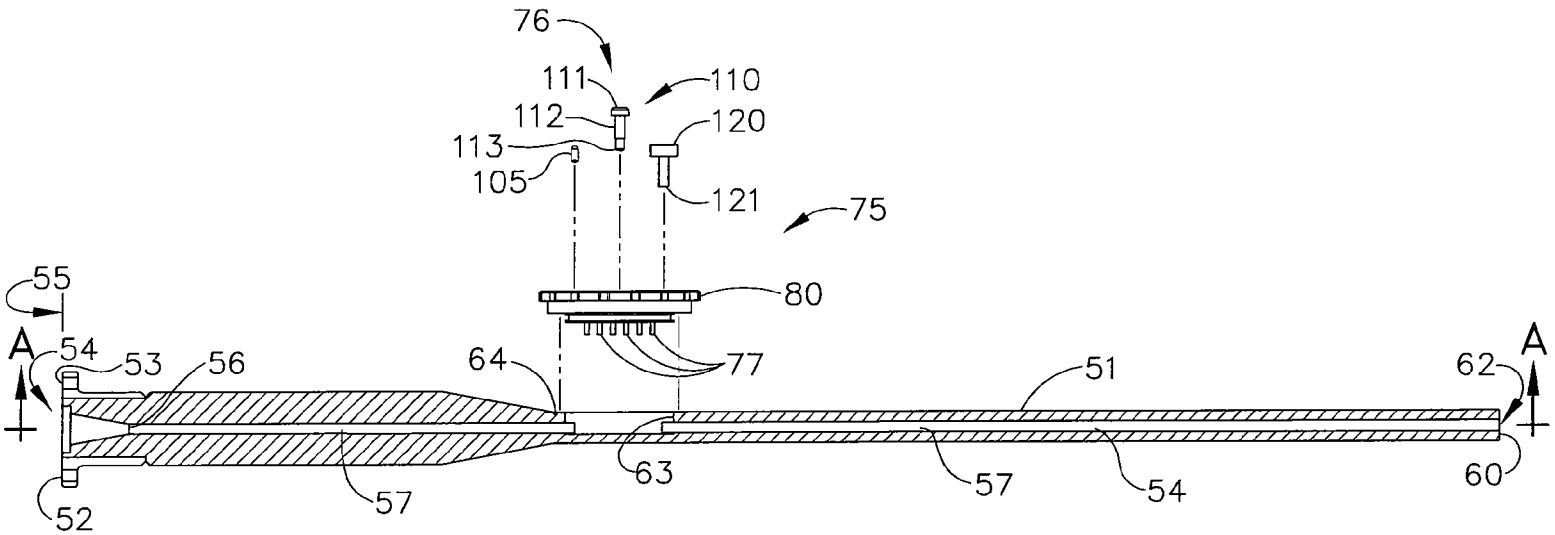
FIG. 4 is a side section view of the nozzle device of FIG. 2 showing the adjustable media size changer exploded.

As shown in FIGS. 2-4, the exemplary nozzle device 50 is an elongated body member 51 having a longitudinal axis 51 and a nozzle passageway 54 extending longitudinally therethrough. Nozzle passageway 54 extends from an attachment member 52 located at an upstream end 53 thereof to a downstream end 60. The attachment member 52 releasably attaches the nozzle device 50 to the downstream coupling 44 of the hose 42. The attachment member 52 can comprise a flange with a bolt pattern therein to releasably attach the nozzle device 50 to the downstream coupling 44. In alternate embodiments, attachment member 52 can comprise a portion of a screw connector, a bayonet connector, a quick release air connector similar to those known to one skilled in the art of air tools or any other suitable coupling. Likewise, for each of these embodiments, the downstream coupling 44 of the hose 42 can be configured mate with the appropriate alternate embodiments of the attachment member 52.

Nozzle passageway 54 is provided for the transit of air and blast media through the nozzle device 50. As best shown in FIGS. 3 and 4, the nozzle passageway 54 has an entrance and an exit and a throat. Nozzle passageway 54 can comprise a converging throat portion 55 that begins as a large circular entrance at the upstream end 53, and necks down to a narrow rectangular opening at a throat 56 of the nozzle device 50. Throat 56 has the smallest cross sectional area of the nozzle passageway 54. A diverging nozzle 57 extends downstream from the throat 56 to the downstream end 60 and terminates in an exit or opening 62 in the downstream end 60. As described, nozzle device 50 is a converging/diverging nozzle with a narrow throat 56 therebetween within the nozzle passageway 54. Dry ice particles or pellets 41 are propelled by compressed air into the entrance of the nozzle passageway 54 and are sped up to a maximum velocity in the diverging nozzle 57. After passing through the nozzle passageway 54, the dry ice particles or pellets 41 are ejected from the opening 62 at a high velocity.

Exemplary Media Size Changer

The exemplary media size changer 75 is attached to the nozzle device 50 and is configured to change a pellet 41 from an initial first size to a second smaller size by fragmenting whole pellets 41 as they travel through the nozzle passageway 54. Moving pellets 41 are fragmented by impact with the media size changer 75 into pellet fragments 43 of reduced size for ejection from the opening 62 in the trailing end 60. The media size changer 75 is shown in FIGS. 1-21, and is operably located at the diverging nozzle 57 between the throat 56 and the downstream end 60. Media size changer 75 comprises one or more media size changing members such as impact members or pins 77 extending into the diverging nozzle 57 of the nozzle passageway 54. Pins 77 are configured to be impacted by moving pellets 41 to fragment the larger uniformed sized pellets 41 into two or more smaller fragments 43. A row of pins 77 can be provided that extends at least part way into the diverging nozzle 57 with each pin 77 spaced apart from adjacent pins 77. The row of pins 77 can extend at least part of the way across the diverging nozzle 57. A distance or spacing between adjacent pins 77 can be used to control the size of the particles 41 or fragments 43 ejected from the nozzle device 50, and this will be discussed in detail below. Pins 77 have an exterior surface for impact with particles 41 and are shown as circular in cross section. In alternate embodiments pins 77 can be any other cross section such as but not limited to oval, rectangular, triangular, hexagonal or any other cross sectional shape that can fragment particles. Alternately, in other embodiments the pins 77 can be an insert assembled with the nozzle device 50 or a feature of the nozzle device 50 such as a casting boss formed therein Adjustable Media Size Changer As shown in FIGS. 1-11, an exemplary adjustable media fragmentation device or adjustable media size changer 76 can be operatively attached to the nozzle device 50 and may be adjusted by an operator to change the size of the blast media being ejected from the opening 62. The exemplary adjustable adjustable media size changer 76 can allow the operator to select between blasting with whole pellets 41, blasting with an adjustable mix of whole pellets 41 and fragments 43, or blasting with pellet fragments 43 in an operator adjustable range of fragment 43 sizes.

The adjustable adjustable media size changer 76 comprises a circular knob assembly 80 configured to rotatably mount within an opening 63 extending into the diverging nozzle 57 of the nozzle device 50. Knob assembly 80 comprises a knob portion 81 that rotates about an axis 100 at a right angle to a fan portion of the diverging nozzle 57 (see FIGS. 5 and 6). Knob portion 81 comprises a circular fluted portion 82 configured to be grasped by a hand, and a circular bearing plate 83 extending concentrically from the circular fluted portion 82 to the diverging nozzle 57. Circular bearing plate 83 has a contact surface 84 configured to rotate on an exterior surface 64 of the nozzle device 50. Knob portion 81 further comprises a circular boss 85 concentrically extending from the contact surface 84 towards the nozzle passageway 54. Circular boss 85 is configured to be rotatably received in the opening 63 within the nozzle device 50 and to have a circular throat surface 86 configured to be flush with an upper surface 97 within the diverging nozzle 57. One or more seal rings 87 can extend between the circular boss 85 and the circular opening 63 to control airflow or leakage therebetween. Seals 87 are shown as a labyrinth seal formed from a rigid knob material, but can comprise an elastomer. In another embodiment, an elastomeric ring seal such as an o-ring (not shown) can be placed around the circular boss 85 between the one or more seal rings 87.

Figure 7:
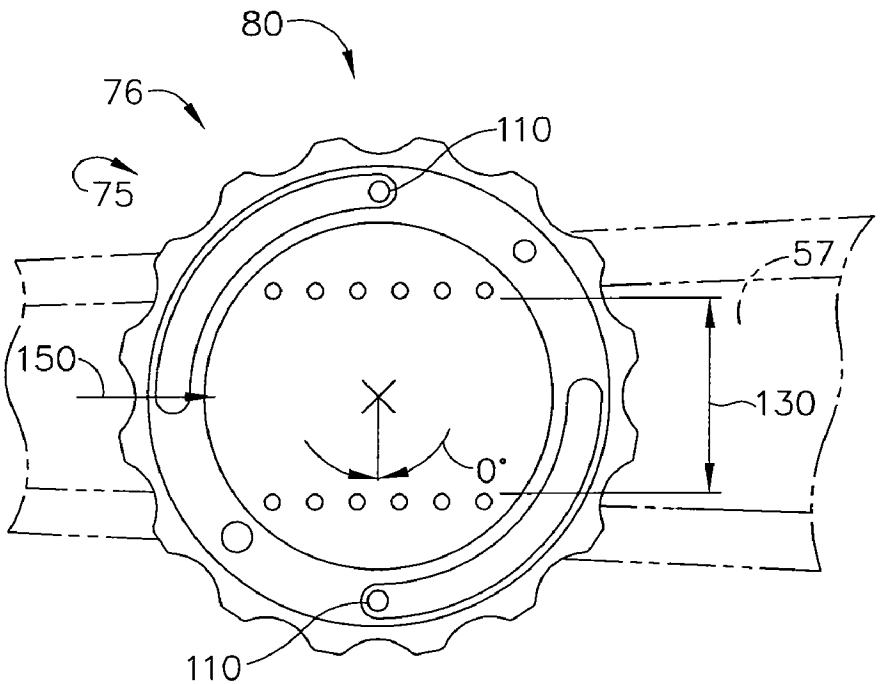
FIG. 7 is a portion of the upward section view of FIG. 3 showing the two parallel rows of media fragmenting pins of the adjustable media size changer at a zero degree angle to place the two rows of pins parallel to a direction of flow of compressed air and media particles through the nozzle device.

The impact members or pins 77 are configured to extend at least part way into the diverging nozzle 70 from the circular throat surface 86 of knob portion 81. Pins 77 can be configured in at least one row or in embodiments, in two parallel rows. Each row of pins 77 can have an even center-to-center pin spacing 78 between centers of adjacent pins 77 and each row of pins 77 may be placed in parallel alignment with the other row. A pin gap 79 exists between each pair of adjacent pins 77 within a row for the passage of particles or pellets 41 therethrough. An operative gap 130 also exists between the adjacent pins 77. Operative gap 130 is the opening or gap provided between adjacent pins 77 for particles 41 to travel between—as viewed along the longitudinal axis. For a row of pins 77 oriented perpendicularly to the longitudinal axis, the pin gap 79 is the same as the operative gap 130 (FIG. 7). For a row of pins 77 rotated to an angle relative to the longitudinal axis, the operative gap 130 or "window" opening for the particles or pellets 41 is reduced, while the pin gap 79 remains the same (See FIGS. 8, 9, and 10). The operative gap 130 controls the maximum size of a pellet 41 or a particle 43 that can fit between adjacent pins 77 and controls the size of the pellet fragments 43 ejected from the nozzle device 50. This will be described in greater detail below.

A pair of curved slots 91 are concentrically located about the axis 89 of the knob portion 81 and are configured to slidingly receive a shoulder screw 110 in each of the slots 91. Shoulder screws 110 are well known in the mechanical arts and comprise a large diameter head 111, a smaller diameter shoulder portion 112 and a smaller diameter threaded portion 113. Threaded portion 113 is configured to be received in threaded holes 65 extending into the outer surface 64 of the nozzle device 50. The shoulder portion 112 is configured to be slidingly received in curved slots 91 and is slightly longer than a depth of the slots. When the circular knob assembly 80 is attached to the nozzle device 50 with shoulder screws 110, the longer length of the shoulder portion 112 provides enough clearance for the knob assembly 80 to be rotated. As shown, slots 91 and shoulder screws 110 provide 90 degrees of rotation for knob assembly 80.

Figure 5:
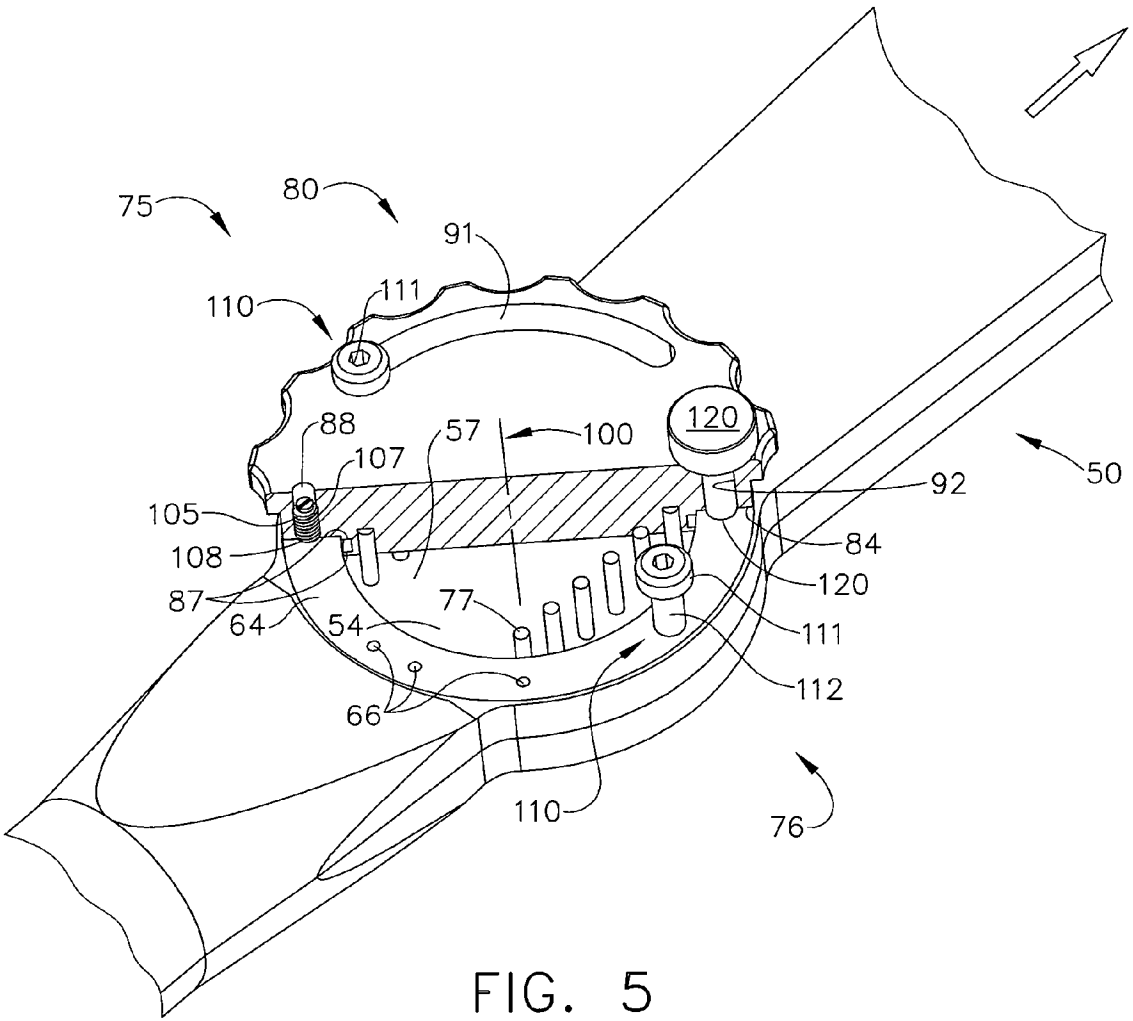
FIG. 5 is a partial isometric view of a top of the nozzle device of FIG. 2 assembled with a partially sectioned adjustable media size changer.
Figure 6:
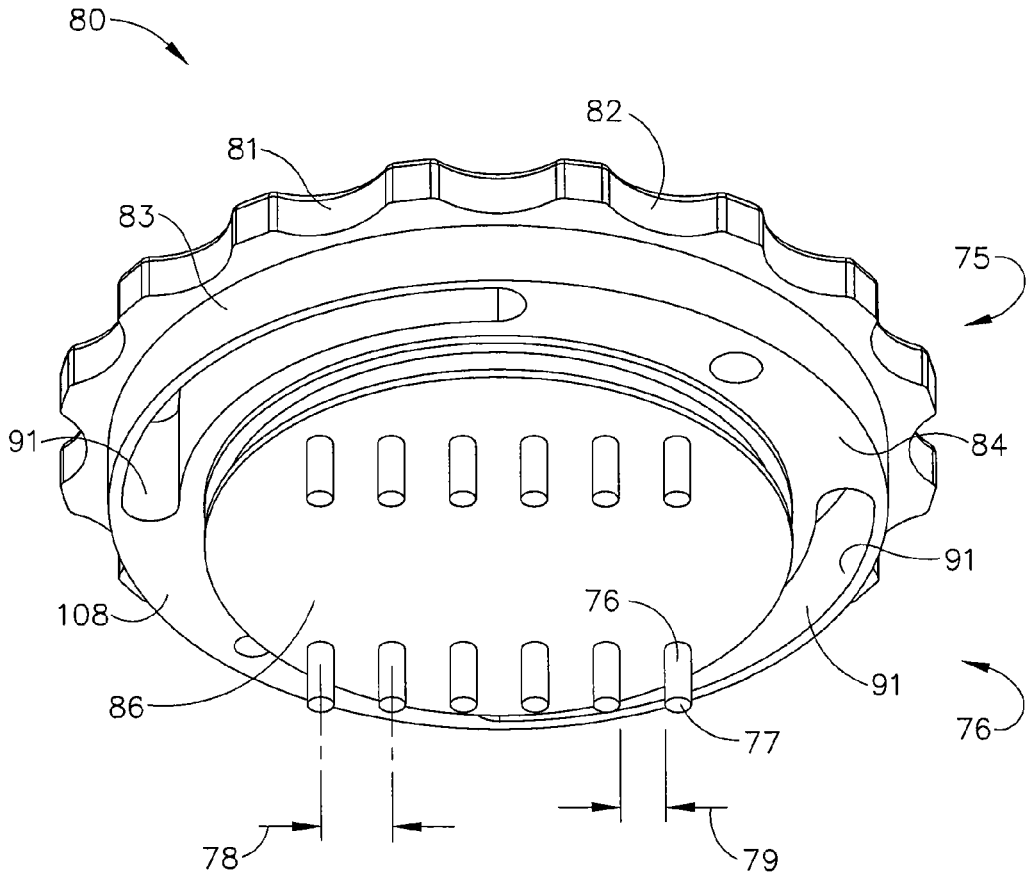
FIG. 6 is an isometric view showing an underside of a circular knob assembly of the adjustable media size changer with two parallel rows of media fragmenting pins extending upwardly therefrom.

A threaded detent hole 88 (FIG. 5) extends through knob assembly 80 and is configured to receive a detent 105 within. Detent 105 engages with the nozzle device 50 and provides audible and/or tactile indicators that the knob assembly 80 is rotated to a select angular position. Detent 105 comprises a threaded body 106 with an internal bias spring 107, and a detent plunger 108 movably captured in threaded body 106. In FIG. 6, an end of the detent plunger 108 is shown biased upwardly by the internal spring 107 to a maximum extended position from the contact surface 84. Detent plunger 108 can be formed from a metal or, from a plastic material such as nylon or acetal to decrease friction against sliding surfaces. In FIG. 5, the detent plunger 108 is shown biased downwardly into contact with the exterior surface 64. Dimples or detents 66 extend into exterior surface 64 at select points for the reception of the downwardly biased end of the detent plunger 108 within. Interaction of the detent plunger 108 and the detents 66 provide the audible and tactile indicators that the knob assembly 80 is rotated to a select angular position at a detent 66. Detent plunger 108 is configured to engage with detents 66 when the knob assembly 80 is at a select angular position, and plunger 108 is configured to disengage with detents 66 and slide on the exterior surface 64 when the adjustable media size changer 76 is rotated between detents 66 or select angular positions.

A locking knob 120 is provided to lock the knob assembly 80 to the nozzle device 50. Locking knob 120 threadably engages with a locking hole 92 within knob portion 81, and has a locking tip 121 configured to lockingly engage with the exterior surface 64. When locking knob 120 is loosened, the locking tip 121 moves away from engagement with the exterior surface 64 and knob assembly 80 is free to rotate. When locking knob 120 is tightened, locking tip 121 is moved into contact with the exterior surface 64 and knob assembly 80 is locked. During operation, adjustable media size changer 76 is rotated to a detent 66 located at a select angular position, and locking knob 120 is tightened to lock the knob assembly 80 at the detent position, Exemplary Select Angular Positions for Adjustable Media Size Changer Rotation of the exemplary adjustable media size changer 76 moves the two rows of pins 77 located within diverging nozzle 57 into positions relative to the longitudinal flow of the compressed air and pellets 41 moving through the nozzle device 50. The angular position of the pins 77 can be adjusted to provide whole pellets 43, a mix of pellets 41 and fragments 43, or pellet fragments 43 of selectable fragment sizes. Select rotational points for the knob assembly 80 are shown in FIGS. 7-10 with information for each select rotational point tabulated in Table 1 below.

Figure 11:
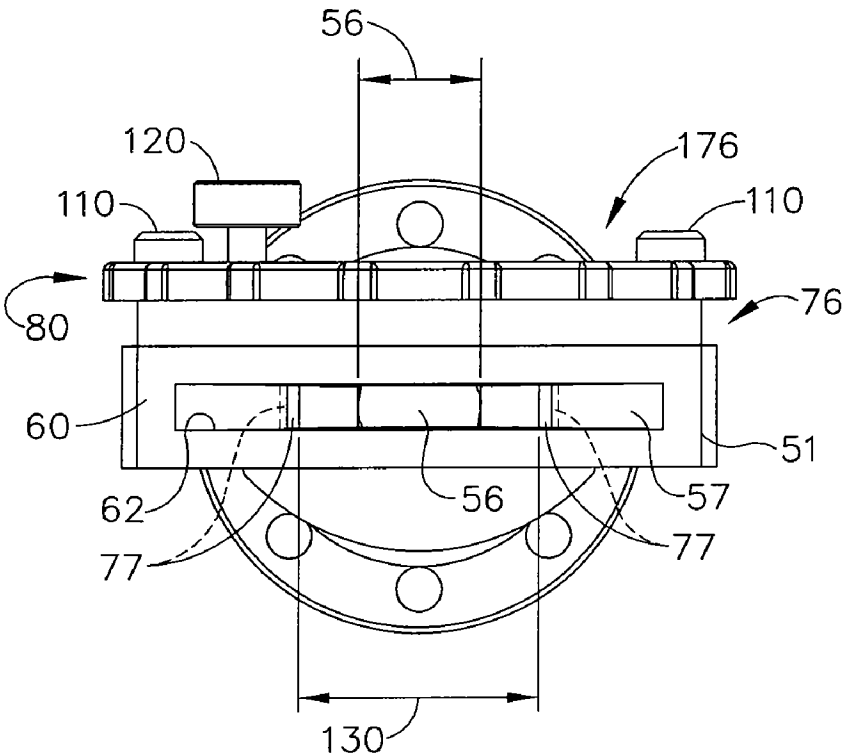
FIG. 11 is an end view of the nozzle device of FIG. 3 showing the pins of the adjustable media size changer at the zero degree position.

FIG. 7 shows a partial upward cross sectional view taken across the nozzle device 50 and along lines A-A as shown in FIG. 4. For clarity, the sectioned body member 51 is shown as dashed lines so that shoulder screws 110 and bottom details of knob assembly 80 can be seen. In this view, knob assembly 80 is at a 0 (zero) degree detent position relative to a line extending between the bottom shoulder screws 110, and the two rows of pins 77 are positioned parallel to the direction of flow as indicated by an arrow 150. An operative gap 130 extends between the parallel rows of pins 77 and provides a gap or passage between pins 77 for the passage of air and pellets 41 through the adjustable media size changer 76 located in diverging nozzle 57. At this position, pins 77 provide an operative gap 130 that is parallel with the longitudinal flow of air and pellets 41, and close to the widest walls of the diverging nozzle 57. An upstream end of each row of pins 77 is recessed just outside of the diverging walls of diverging nozzle 57, and a downstream end of each row of pins 77 is extending just inside the diverging walls. An end view looking at the downstream end 60 and into the diverging nozzle 57 through opening 62 is shown in FIG. 11. Dimensional and rotational values for the configuration are tabulated in Table 1 below. For all angles other than this zero degree position, the operative gap 130 is calculated with a formula wherein the OG or operative gap 130 is: OG=cos(90−x)*(y) wherein x is an angle in degrees from a line perpendicular to the longitudinal axis of the nozzle device (passing through pins 110), and y is the pin gap 79.

Figure 8:
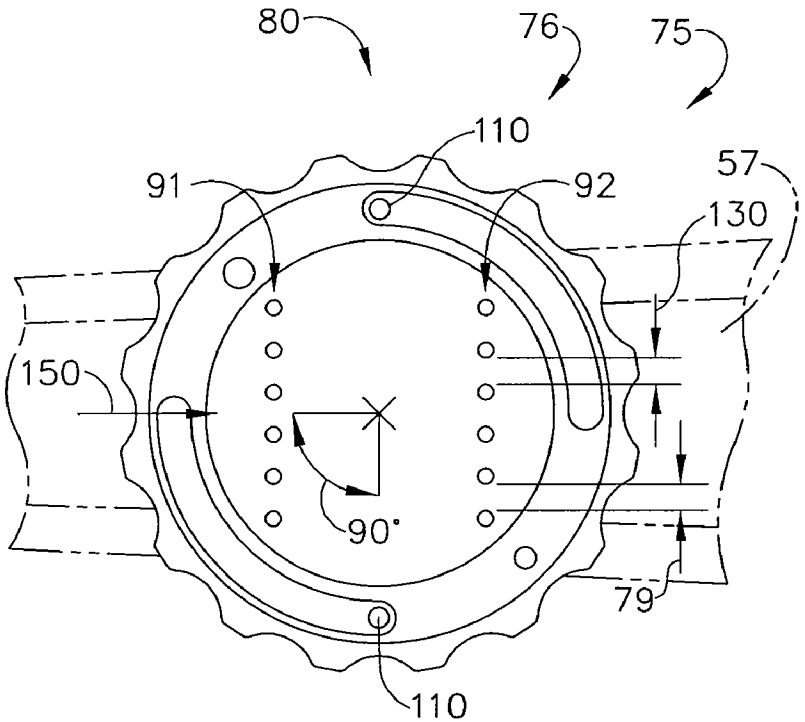
FIG. 8 is a portion of the upward section view of FIG. 7 showing the two parallel rows of media fragmenting pins of the adjustable media size changer rotated to a ninety degree angle from the position of FIG. 7 to place the two rows of pins perpendicular to the direction of flow of compressed air and media particles through the nozzle device.

In FIG. 8, the operator has rotated the adjustable media size changer 76 to a position 90 degrees from that shown in FIG. 7. In this position, the angle x is at 90 degrees of rotation as measured from the line passing through shoulder screws 110. At this angle of x=90 degrees, rotation has moved the two rows of pins 77 to a position where each row extends perpendicularly across the direction of flow 150, and at 90 degrees thereto. For x=90 degrees, and y=0.121 inches the OG (or operative gap 130) is calculated to be 0.121 inches and this value is the same as pin gap 79 as shown in Table 1 below. At this 90 degree position, both an upstream row of pins 91 and a downstream row 92 of pins are in longitudinal alignment (aligned along the direction of flow 150) and shield the downstream row of pins from impact with pellets 41. Pellets 41 traveling through the adjustable media size changer 76 will collide with the upstream row of pins 77 and become fragments 43 (not shown) that will fit between operative gap 130 (pin gap 79) in the upstream and downstream rows of pins 77. The operative gap 130 between pins 77 controls the maximum size of the fragments 43 that can fit between pins 77, and this controls the size of the fragments 43 that can be ejected from the nozzle device 50. Changes in the operative gap, a change in number of openings exposed to the pellets 71 and the sum of all operative gaps for FIG. 8 are shown in Table 1 below.

Figure 9:
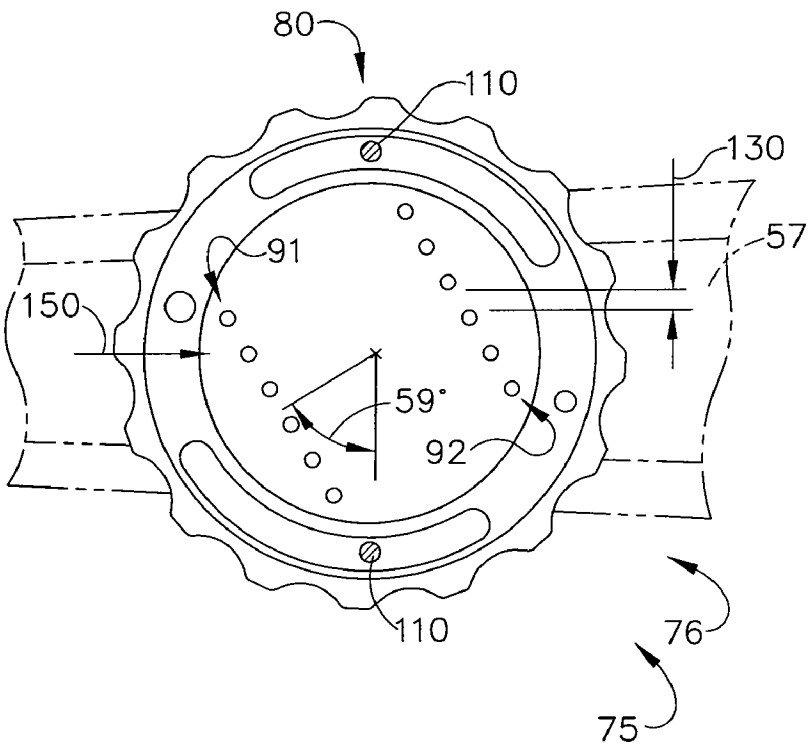
FIG. 9 is a portion of the upward section view of FIG. 7 showing the two parallel rows of media fragmenting pins of the adjustable media size changer rotated to a fifty nine degree angle from the position of FIG. 7 to place the two rows of pins at an angle to the direction of flow of compressed air and media particles through the nozzle device.

In FIG. 9, the operator has rotated the adjustable media size changer 76 to a position 59 degrees from shoulder screw 110. In this position, the operative gap 130 has changed (according to the above formula) to a value of about 0.091 inches as shown in Table 1 below. As shown in FIG. 9, the upstream row 91 and downstream row 92 of pins 77 are each angled partially across the diverging nozzle 57 and the rows 91, 92 overlap. The overlapped pair of rows 91, 92 extends fully across the diverging nozzle 57 and across the direction of flow 150. Where the upstream row 91 and the downstream row 92 overlap, the pins 77 in the downstream row 92 are positioned directly behind pins 77 in the upstream row 92 (along the direction of flow 150). Thus, a majority of the pellets 91 will be fragmented by the upstream row 91, and those moving pellets 41 that are not positioned to impact with the upstream row 91 will be fragmented by the downstream row 92. Fragments 43 from the upstream row 91 pass through operative gaps 130 in the downstream row 92. Values for the 59 degree position shown in FIG. 9 are tabulated in Table 1.

Figure 10:
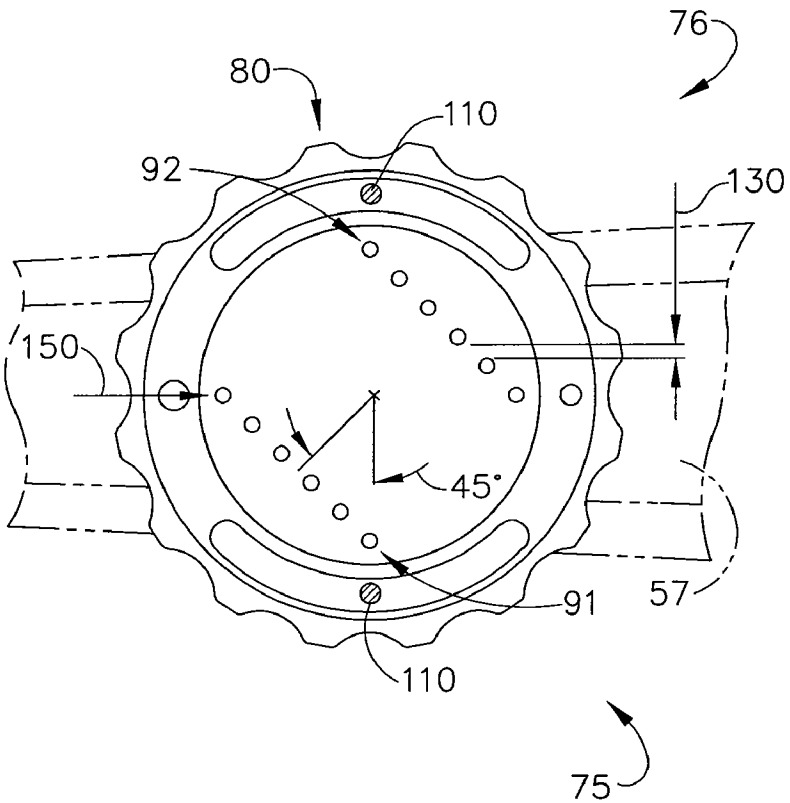
FIG. 10 is a portion of the upward section view of FIG. 7 showing the two parallel rows of media fragmenting pins of the adjustable media size changer rotated to a forty-five degree angle from the position of FIG. 7 to place the two rows of pins at an angle to the direction of flow of compressed air and media particles through the nozzle device.

In FIG. 10, the operator has once again rotated the adjustable media size changer 76 to a new position at 45 degrees from the line extending through shoulder screws 110. Using the above formula, the operative gap 130 or OG is now about 0.059 inches as shown in Table 1 below. Operative gap 130 is now at a minimum value and the angled upstream row 91 and the angled downstream row 92 overlap at one pin 77. A larger number of pins 77 in the downstream row 92 are now exposed to the incoming stream of air and pellets 41, and a lesser number of pins 77 in the upstream row 91 are exposed. Fragmentation of pellets 41 is now slightly greater with the upstream row 91 than with the downstream row 92. Once again, values are tabulated in Table 1.

The description and values of Table 1 are merely illustrative of how the adjustable media size changer 76 can provide the operator with a selectable set of operative gaps 130, and the adjustable media size changer 76 is not limited thereto. Each operative gap 130 shown in Table 1 is a maximum size for the pellets 41 or fragments 43 that can pass through each above operative gap 130. Operative gaps 130 are not limited to the values in Table 1 above, and the adjustable media size changer 76 can be configured to eject fragments 43 that can fit between an operative gap range of about 0.5 inches to about 0.001 inches.

TABLE 1

Operative Gaps between Pins for FIGS. 8-10

| FIG. | "x" = Angle of knob - where angle "x" is measured from a line extending through screws 110. - in Degrees | Number of Openings exposed | "y" = Pin Gap 79 - in inches | Operative Gap 130 = OG = cos(90 − x) * (y) - in inches | Sum of Operative Gaps between Pins - in inches |
|---|---|---|---|---|---|
| 7 | 0 | 1 | .121 | .984 | .984 |
| 8 | 90 | 6 | .121 | .121 | .606 |

TABLE 1-continued

Operative Gaps between Pins for FIGS. 8-10

| FIG. | "x" = Angle of knob - where angle "x" is measured from a line extending through screws 110. - in Degrees | Number of Openings exposed | "y" = Pin Gap 79 - in inches | Operative Gap 130 = OG = cos(90 − x) * (y) - in inches | Sum of Operative Gaps between Pins - in inches |
|---|---|---|---|---|---|
| 9 | 59 | 5 | .121 | .091 | .546 |
| 10 | 45 | 5 | .121 | .059 | .357 |

Figure 12:
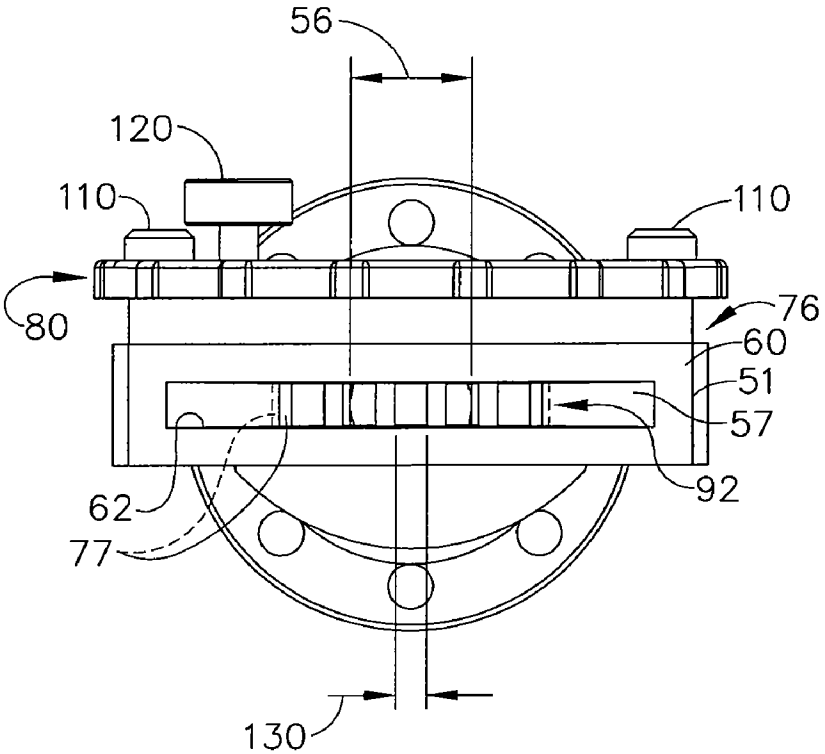
FIG. 12 is an end view of the nozzle device of FIG. 3 showing the pins of the adjustable media size changer at the ninety degree position.

FIGS. 11 and 12 are downstream end views of the nozzle device 50 with the adjustable media size changer 76 in position. In FIG. 11, the throat 56 and 65 and the diverging nozzle 57 of the nozzle passageway 54 can be seen through the opening 62. Two rows of pins 77 are seen end on. In FIG. 12, the adjustable media size changer 76 is rotate to the 90 degree position of FIG. 8. The trailing row 92 of pins 77 can be seen through the opening 62 and row 92 is parallel with the trailing end 62.

Figure 13:
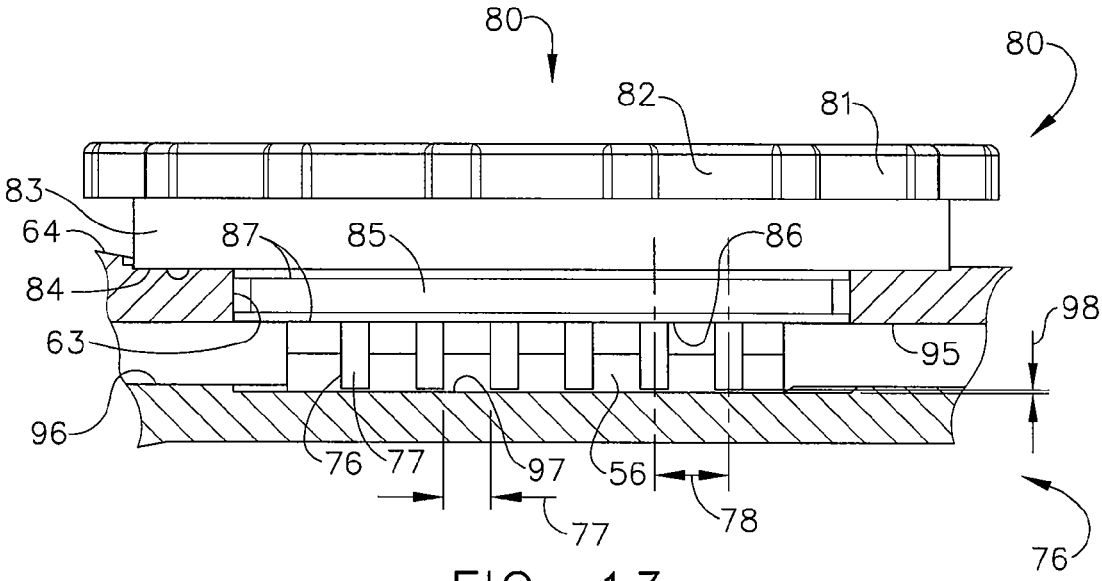
FIG. 13 is a partial cross section of the end view of the nozzle device of FIG. 12 showing the pins of the adjustable media size changer at the ninety degree position and with the pins extending into a pocket on an opposite side of the diverging portion.

FIG. 13 is a cross-sectional view of an embodiment of the nozzle device 50 along B-B and shows the adjustable media size changer 76 un-sectioned. Adjustable media size changer 76 is in the 90 degree position shown in FIGS. 7 and 12 and the direction of flow is out of the page. Circular throat surface 86 is aligned with an upper surface 95 of the diverging nozzle 57 to reduce turbulence. A lower surface 96 of the diverging nozzle 57 has a pocket 97 cut therein to a depth 99 for the pins 77 to extend into. Pocket 97 ensures that pins 77 extend fully across a height of the diverging nozzle 97 but can induce turbulence.

Figure 14:
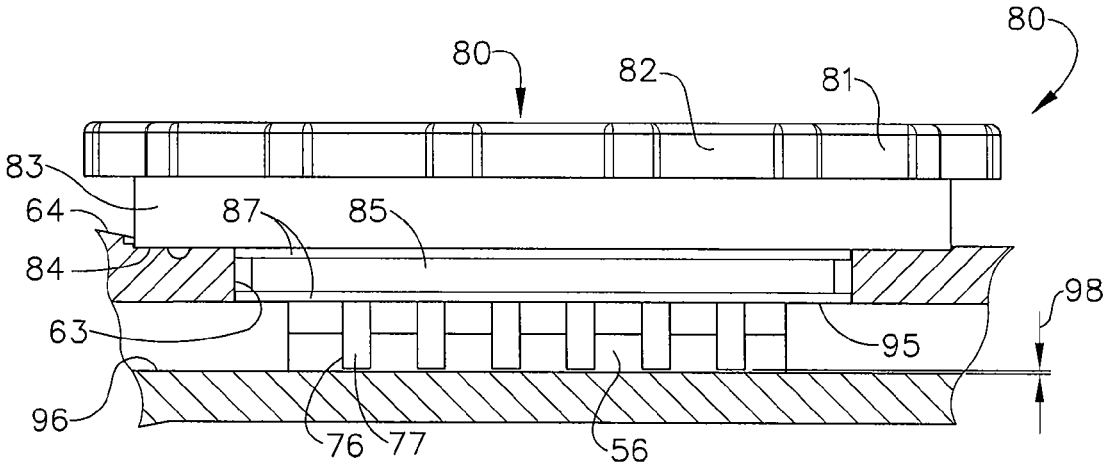
FIG. 14 is a partial cross section of the end view of the nozzle device of FIG. 12 showing the pins of the adjustable media size changer at the ninety degree position and with the pins stopping above the opposite side of the diverging portion.

FIG. 14 is also a cross-sectional view of another embodiment of the nozzle device 50 taken in the direction of section B-B and shows the adjustable media size changer 76 un-sectioned. In FIG. 13, free ends of the pins 77 are spaced away from the surface 96 of the diverging nozzle 57 and are close to but do not touch surface 96 of the diverging nozzle 57. This configuration eliminates pocket 97 of FIG. 13, provides a smooth lower surface 96, and reduces turbulence.

Figure 15:
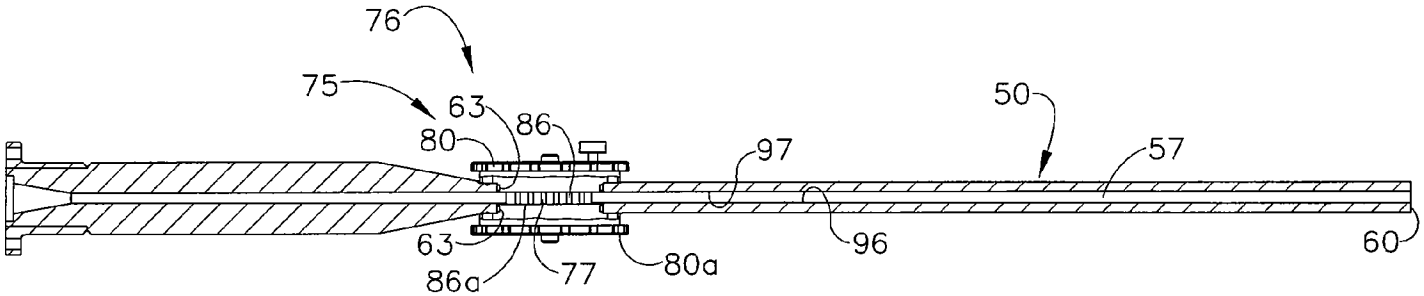
FIG. 15 is a side section view of the nozzle device of FIG. 2 showing an alternate embodiment of the adjustable media size changer.
Figure 16:
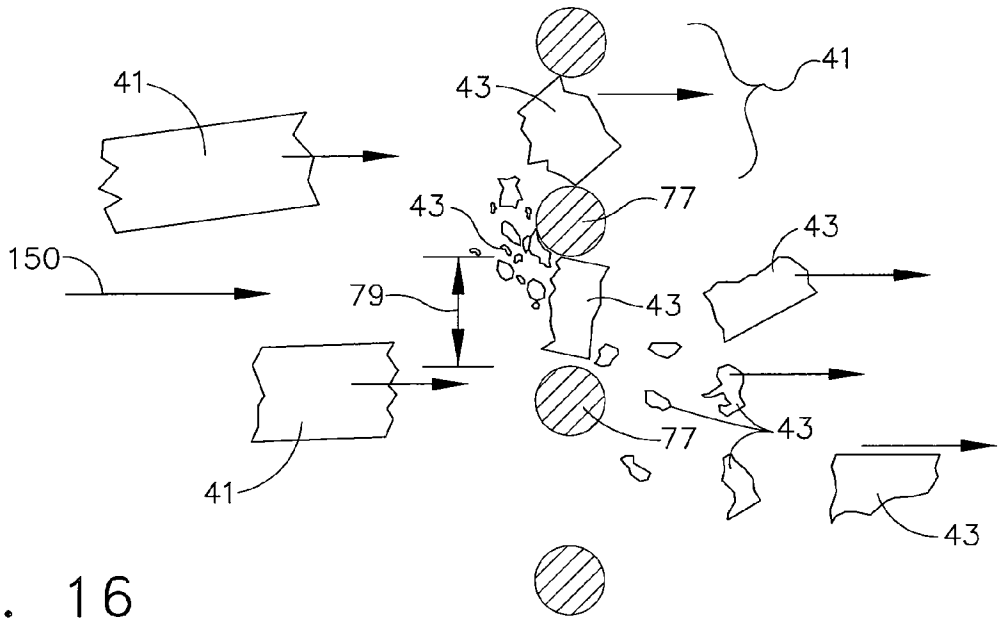
FIG. 16 is a top view of pins of the media size changer with air and particles moving along the direction of flow and with a particle or pellet of dry ice impacting one of the pins to produce fragments.

FIG. 15 is a cross-sectional view of yet another alternate embodiment of the adjustable media size changer 76. In this embodiment, the opening 63 extends through both upper surface 97 and lower surface 96 within the nozzle device 50. An upper knob portion 80 and a lower knob portion 80*a* are placed in openings 63 with pins 97 extending therebetween. This embodiment provides two circular throat surfaces 86, 86*a* on knob portions 80, 80*a* that are flush with the upper surface 97 and lower surface 96 of diverging nozzle 57.

FIG. 16 shows how the pins 77 of the media size changers 75, 76 use the impact of pellets 41 with the pins 77 to create smaller sized particles or fragments 43. In this view, four pins 77 are shown spaced equidistantly apart with a pin gap 79 between each adjacent pair of pins. A plurality of pellets 41 are being propelled by the compressed air in the direction of flow 150. One pellet 41 has impacted with an upper one of the central pins 77 and is fragmenting into fragments 43. The fragments 43 either fit within the pin gap 79 to be propelled downstream, or are too large to fit within the pin gap 79. Fragments 73 that are too large to fit within gap 79 can be impacted by another pellet 41 and fragmented a second time to fit within the gap 79. Once past the pin gap 79, the fragments 43 are propelled downstream by the flow of air to be ejected from the opening 62.

Figure 17:
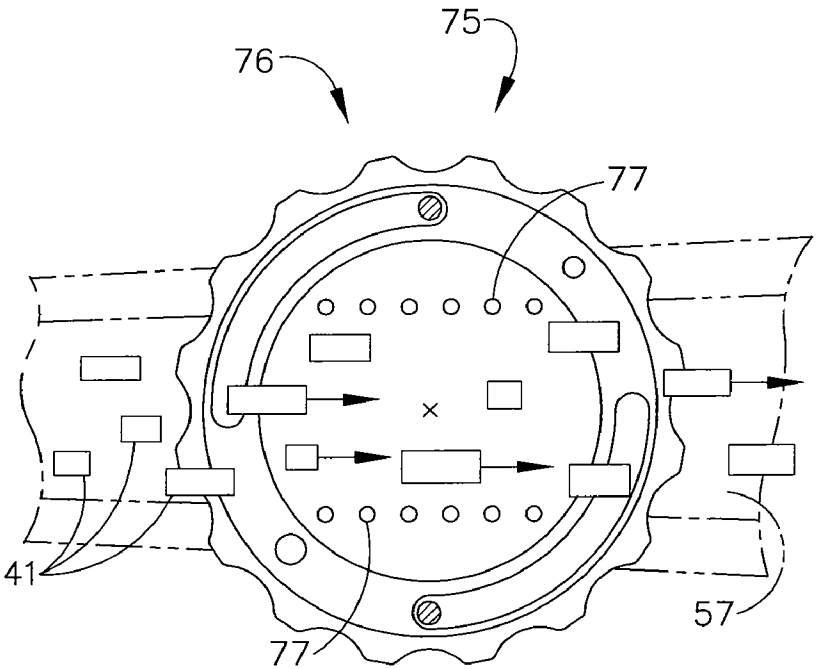
FIG. 17 the view of FIG. 7 with the media fragmenting pins of the adjustable media size changer parallel to the direction of flow and with pellets moving through the media size changer and nozzle device without impacting the pins.

FIG. 17 shows the view of FIG. 8 with a plurality of pellets 41 being propelled along the converging nozzle 57 and between rows of pins 77 of the adjustable media size changer 76. With the adjustable media size changer 76 at a zero degree position, the pins 77 are parallel to the direction of flow and no pins 77 are across the path of the incoming compressed air and pellets 41. In this configuration, pellets 41 pass through the adjustable media size changer 76 without fragmenting and are ejected from the nozzle device 50 whole.

Figure 18:
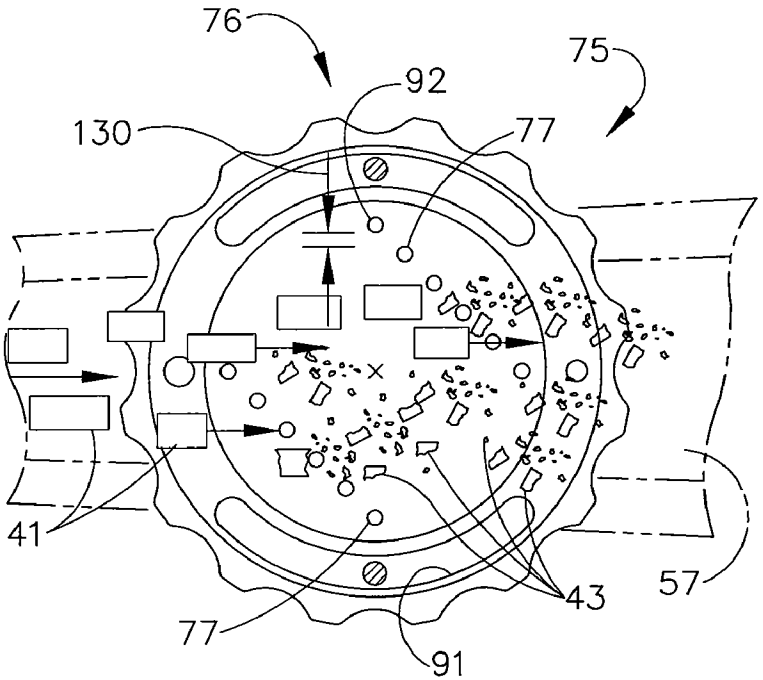
FIG. 18 the view of FIG. 10 with the media fragmenting pins of the adjustable media size changer at a forty-five degree angle from the view of FIG. 17 and with moving pellets impacting the media fragmenting pins to produce fragments moving downstream through the nozzle device.

FIG. 18 shows the view of FIG. 10 with a plurality of pellets 41 being propelled through the adjustable media size changer 76 with the size changer 76 in the 45 degree position. The upstream row 91 of pins 77 is fragmenting some of the pellets 11 and the downstream row 92 is fragmenting the remainder of pellets 41. All fragments 43 must fit through one or more operative gaps 130 and all fragments 43 are ejected from the opening 62 of the downstream end 60.

Figure 20:
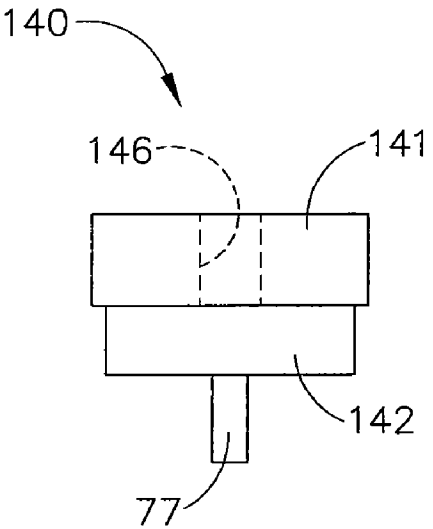
FIG. 20 is an end view of the strip fragmentation device of FIG. 19.
Figure 19:
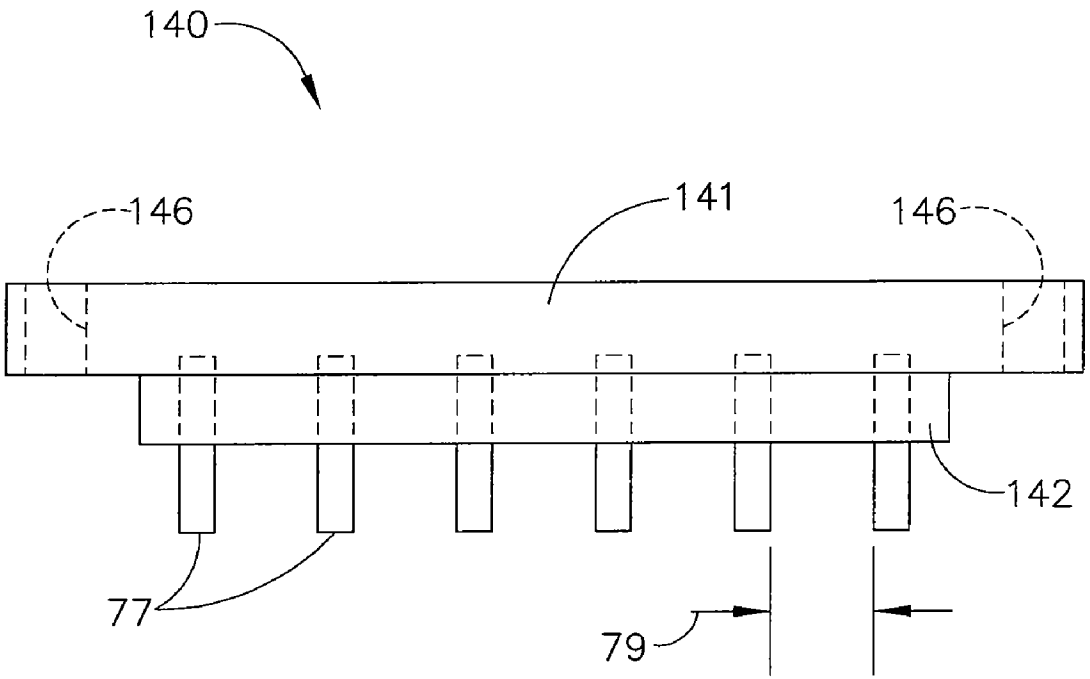
FIG. 19 is a side view of a strip fragmentation device having a row of equally spaced apart pins extending therefrom.
Figure 21:
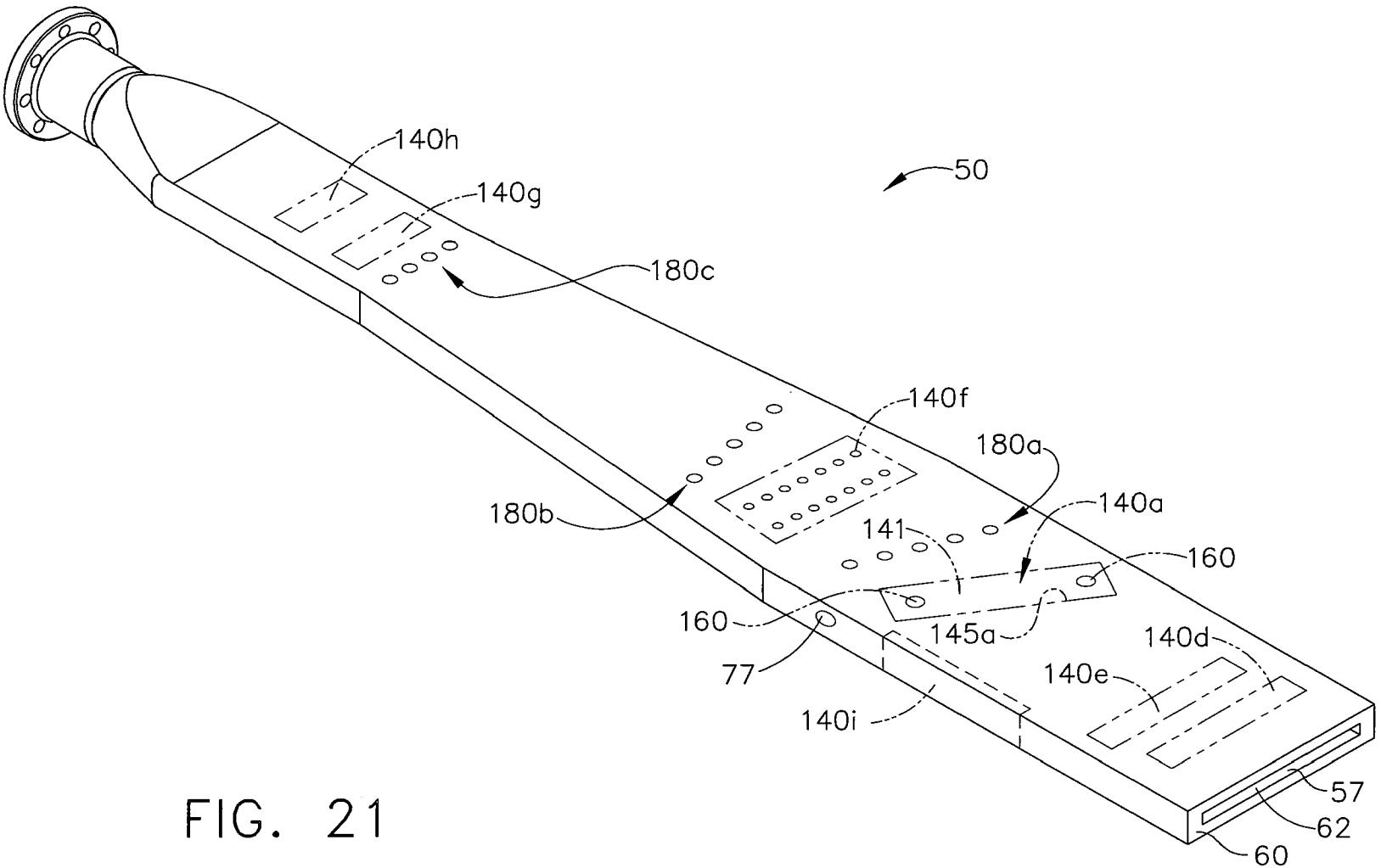
FIG. 21 is an isometric view of a nozzle device showing a plurality of locations for the strip fragmentation device and showing placement of one or more individual pins into the nozzle device.

FIGS. 19-21 show an alternate embodiment of media size changer 75 comprising a linear row of pins 77 in a strip fragmentation device 140. Strip fragmentation device 140 comprises a rectangular plate 141 that attaches to a rectangular opening 145 in nozzle device 50 with a row of pins 77 extending into the diverging nozzle 57. A step 142 can extend into rectangular plate 141 to improve sealing of strip fragmentation device 140 with a stepped opening 145 in nozzle device 50. Pins 77 extend in a row from rectangular plate 141 with equally spaced pin gaps 79 between adjacent pins 77. Strip fragmentation device 140 can be permanently or removably attached to nozzle device 50. Strip fragmentation device 140 shown in FIGS. 19 and 20 has a pair of holes 146 extending through rectangular plate 141. Holes 146 can receive a screw 160 therein to removably attach strip fragmentation device 140 to nozzle device 50. In embodiments, a nozzle device 50 configured to work with strip fragmentation device 140 can include a plurality of strip fragmentation devices 140, each with a different pin gap 79 between the pins 77. With replaceable strip fragmentation devices 140 and different pin gaps on each strip 140, an operator can change the size of the fragments 43 being ejected from the device by changing from a first strip fragmentation device 140*a* with a first pin gap 79*a* to a second strip fragmentation device 140*b* with a second (and different) pin gap 79*b* (not shown). FIG. 21 shows a plurality of locations for strip devices 140 on the nozzle device 50. A removable strip 140*a* is shown placed in hole 145*a* and constrained therein with screws 160.

A plurality of alternate locations for one or more strip fragmentation devices 140 are shown as dashed lines on the nozzle device 50. In alternate embodiments, strip fragmentation devices 140 can contain one or more rows of pins 77 such as strip fragmentation device 140*f*. In other alternate embodiments, a pair of rows of strip fragmentation devices 140 can be placed in staggered orientation as shown by dashed outlines for strip fragmentation devices 140*d* and 140*e* or in parallel orientations as shown by strip fragmentation devices 140*g* and 140*h*. And, in another embodiment, strip fragmentation device 140 can be placed on a side of the nozzle 50.

In another embodiment of the nozzle fragmentation device 75, one or more pins 77 or rows of pins 180 can extend into the diverging nozzle 57 of the nozzle device 50 to fragment pellets 43 traveling therethrough. Three rows of pins 80*a*, 80*b*, and 80*c* are shown extending into nozzle device 50. A single pin 77 is also shown.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While the present nozzle device has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

For example, in alternate embodiments, rows of pins 77 can be straight rows, curved rows, "U" shaped rows, "W" shaped rows or any other pattern of pins that can change the size of a particle or pellet 41 into smaller fragments 43.

And, in another example of an alternate embodiment, an alternate adjustable media size changer 276 can have a raised rib or member 282 extending from a knob 280. Member 282 and knob 280 can be configured to have a knob shape similar to that found on a stove knob, and the operator can grasp and rotate knob 280 with the upwardly extending member 282. Alternate adjustable media size changer 276 can be attached to the elongated body member 51 as a replacement for the above described adjustable media size changer 76.

And, in other alternate embodiments, the strip fragmentation device 140 can be configured to move or slide linearly relative to the nozzle device 50 such as perpendicular to the direction of flow 150.

What is claimed is:

1. A nozzle for the ejection of dry ice particles therefrom, the nozzle connected to a flow of compressible fluid and uniformly sized dry ice particles for ejection from the nozzle, the nozzle comprising:

a nozzle body having a longitudinal axis;

a passageway extending through the nozzle body and along the longitudinal axis for the passage of the compressible fluid and the dry ice particles therethrough, the passageway having an entrance and an exit and a throat therebetween with a converging portion between the inlet and the throat, and a diverging portion between the throat and the exit; and wherein the diverging portion of the nozzle body further comprises means for changing the uniformly sized dry ice particles from a first size to a smaller second size for ejection from the nozzle.

2. The nozzle of claim 1 wherein the means for changing further comprise at least one impact member extending into the diverging portion of the nozzle to fragment the moving uniformly sized dry ice particles from the first size to the second size when the moving particles impact the impact member.

3. The nozzle of claim 2 wherein the means for changing further comprise a row of impact members extending into the diverging portion and each impact member has an operative gap between adjacent impact members configured to pass moving dry ice particles of the first size or the second size therebetween.

4. The nozzle of claim 3 wherein the operative gap is uniform between adjacent impact members along the row of impact members.

5. The nozzle of claim 4 wherein when the operative gap is larger than the first size of the uniformly sized dry ice particles, at least some of the moving dry ice particles of the first size pass through the operative gap without impacting the impact member, and at least some of the dry ice particles of the first size impact with the impact member to pass through the operative gap as dry ice particles of the smaller second size, wherein the dry ice particles ejected from the nozzle are a mix of first size and second size particles.

6. The nozzle of claim 4 wherein when the operative gap is smaller than the first size of the dry ice pellets, all of the moving dry ice particles of the first size impact with at least one impact member to change the moving dry ice particles from the first size to the smaller second size to pass through the operative gap, wherein the dry ice particles ejected from the nozzle are all particles of the second size and all of the particles of the second size are smaller than the operative gap.

7. The nozzle of claim 4 wherein the means for changing at least one of the dry ice particles from the first size to the smaller second size are operator adjustable to different positions to change the operative gap between adjacent pins in the row of pins and to change the particle size of at least some of the dry ice particles ejected from the nozzle.

8. The nozzle of claim 7 wherein the means for changing at least one of the dry ice particles from the first size to the smaller second size are rotatable to change the operative gap between adjacent pins and to change the particle size of at least some of the dry ice particles ejected from the nozzle.

9. The nozzle of claim 7 wherein the means for changing at least one of the dry ice particles from the first size to the smaller second size are adjustable to a position wherein all of the dry ice particles are ejected from the nozzle as particles of the first size.

10. The nozzle of claim 7 wherein the means for changing at least one of the dry ice particles from the first size to the smaller second size are adjustable to a position wherein dry ice particles are ejected from the nozzle as a mix of particles of the first size and particles of the second size.

11. The nozzle of claim 7 wherein the means for changing at least one of the dry ice particles from the first size to the smaller second size are further adjustable through a range of positions wherein each position has a different operative gap and each operative gap passes a carbon dioxide particle of the second size that is smaller than the operative gap.

12. A nozzle for ejecting a blasting stream of air and sublimable particles against a surface, the nozzle comprising:

(a) a nozzle body having an exterior surface and a longitudinal axis;

(b) a passageway extending through the nozzle body for moving passage of the blasting stream of air and sublimable particles longitudinally therethrough, the passageway having an inlet and an exit and a throat therebetween, a converging section extends between the inlet and the throat and a diverging section extends between the throat and the exit, and an interior surface; and (c) a particle size changing member within the diverging portion of the nozzle, the particle size changing member operably configured to change at least one sublimable particle from a first particle size to a second particle size within the diverging portion of the nozzle prior to ejection of the moving sublimable particles from the nozzle.

13. The nozzle of claim 12 wherein the first particle size is larger than the second particle size.

14. The nozzle of claim 13 wherein the particle size changing member changes the at least one sublimable particle from a first particle size to a second particle size by impacting the moving particle with the particle size changing member.

15. The nozzle of claim 12 wherein the particle size changing member has at least one impact surface for impact with moving sublimable particles.

16. The nozzle of claim 15 wherein at least a portion of the impact surface is arcuate.

17. The nozzle of claim 12 wherein the particle size changing member is a row of pins extending into the diverging portion of the passageway with a pin gap between adjacent pins for the blasting stream of air and sublimable particles to pass therebetween.

18. The nozzle of claim 17 wherein the pin gaps are sized to be smaller than the first particle size of the at least one sublimable particles.

19. The nozzle of claim 17 wherein the row of pins is oriented perpendicular to the longitudinal axis of the nozzle body.

20. The nozzle of claim 17 wherein the row of pins is oriented parallel to the longitudinal axis of the nozzle body.

21. The nozzle of claim 17 wherein the row of pins is oriented at an angle to the longitudinal axis of the nozzle body.

22. The nozzle of claim 21 wherein when the row of pins is oriented at an angle x from a line perpendicular to the longitudinal axis of the nozzle body and the pin gap is y, an operative gap OG is provided between adjacent pins for the passage of air and sublimable particles therethrough, wherein the operative gap OG is determined from the equation: $OG=\cos(90-x)*(y)$.

23. The nozzle of claim 22 wherein the angle x of the row of pins is adjustable through an angular range between about zero degrees to an angle of about 90 degrees.

24. A method of changing a size of a blast media particle within a blast media ejection nozzle, comprising:

(a) providing a blast media nozzle having a longitudinal axis and comprising;

a passageway extending longitudinally therethrough with an entrance and an exit and a throat therebetween, a converging passageway converging downstream from an inlet of the nozzle, a diverging passageway downstream from the converging passageway and having an exit, and a media size changing member located within the diverging passageway;

(b) propelling a plurality of blast media particles of generally uniform first size through the passageway of the blast media nozzle entrained in a transport gas; and (c) changing at least one of the propelled plurality of blast media particles from the generally uniform first size to a smaller second size with the media size changing member prior to ejection from the nozzle.

25. The method of claim 24 wherein the step of changing at least one of the propelled plurality of blast media particles from the generally uniform first size to a second size includes impacting the media size changing member with at least one of the propelled plurality of blast media particles to fragment the impacted blast media particle.

26. The method of claim 24 wherein the plurality of blast media particles comprise carbon dioxide pellets.

27. The method of claim 24 further comprising repositioning the media size changing member within the diverging passageway to change the second size of at least one of the propelled plurality of blast media particles being ejected from the nozzle.

* * * * *